United States Patent [19]

Kempe

[11] Patent Number: 4,521,066

[45] Date of Patent: Jun. 4, 1985

[54] ELECTRICAL CONNECTOR WITH NON-PRECOCKABLE COUPLING RING

[75] Inventor: Hans I. Kempe, Redlands, Calif.

[73] Assignee: The Deutsch Company, Electronic Components Division, Banning, Calif.

[21] Appl. No.: 595,687

[22] Filed: Apr. 2, 1984

[51] Int. Cl.[3] ..... H01R 13/623

[52] U.S. Cl. ..... 339/89 M; 339/DIG. 2

[58] Field of Search ..... 339/89 R, 89 C, 89 M, 339/90 R, 90 C, DIG. 2; 285/82, 84, 86, 89, 92

[56] References Cited

U.S. PATENT DOCUMENTS

| | | | |
|---|---|---|---|
| 3,848,950 | 11/1974 | McCormick et al. | 339/90 R |
| 4,066,315 | 1/1978 | Arneson | 339/89 |
| 4,106,839 | 8/1978 | Cooper | 339/143 |
| 4,123,842 | 11/1978 | Cooper | 29/592 |
| 4,183,605 | 1/1980 | Arneson | 339/89 |
| 4,468,077 | 8/1984 | Brush, Sr. et al. | 339/89 M |

FOREIGN PATENT DOCUMENTS

| | | | |
|---|---|---|---|
| 2052179 | 1/1981 | United Kingdom | 339/89 M |

*Primary Examiner*—John McQuade

*Attorney, Agent, or Firm*—Gausewitz, Carr, Rothenberg & Edwards

[57] ABSTRACT

The plug shell and receptacle of an electrical connector have registration keys and keyways that are alignable in a single rotational position. A coupling ring mounted for rotation on a plug shell has a mating set of keys and keyways that must be aligned with the registration elements of the plug shell and receptacle for insertion of the receptacle into the plug shell. After such insertion has been accomplished, the coupling ring is rotated to further draw the receptacle and plug shell together and to prevent axial separation of the plug shell and receptacle. In order to positively prevent precocking of the coupling ring prior to insertion of the receptacle into the plug shell, a locking finger is resiliently pivoted to the plug shell, having one part entering a locking recess of the coupling ring and a second part entering the plug shell bore into which the receptacle is to be inserted. Insertion of the receptacle into the plug shell bore swings the locking finger out of the coupling ring locking recess to enable rotation of the coupling ring only after partial insertion of the receptacle into the plug shell bore.

16 Claims, 7 Drawing Figures

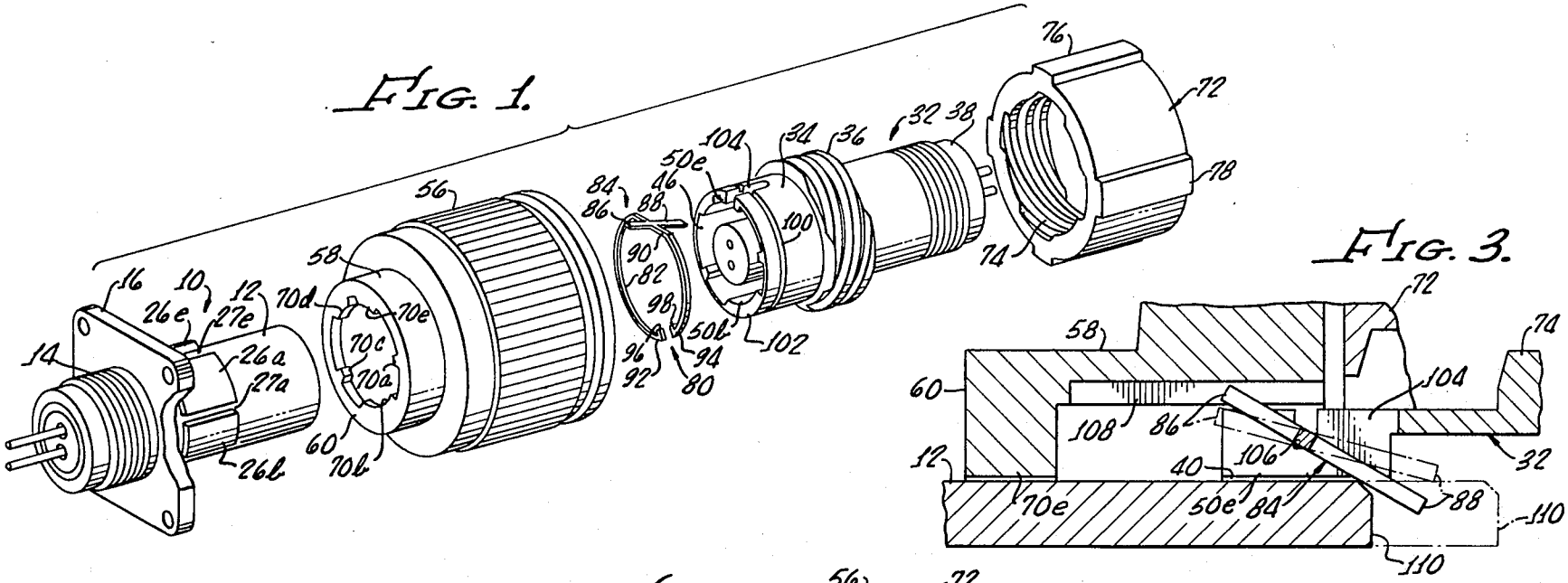
FIG. 1.
FIG. 3.
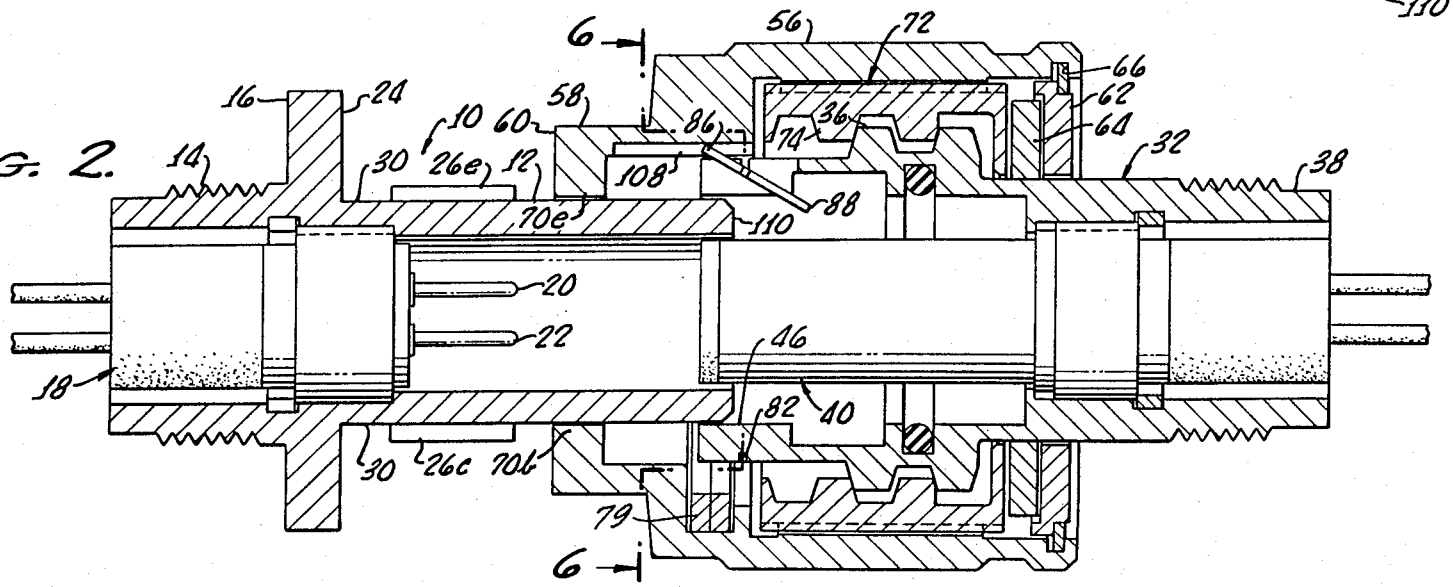
FIG. 2.

ELECTRICAL CONNECTOR WITH NON-PRECOCKABLE COUPLING RING

BACKGROUND OF THE INVENTION

The present invention relates to electrical connectors and more particularly concerns an arrangement for preventing inadvertent cocking of a connector coupling ring.

An electrical connector of known configuration, such as shown in U.S. Pat. Nos. 4,066,315, 4,106,839, 4,123,842 and 4,183,605 includes a receptacle and plug shell having keys and keyways that may be mutually registered, in rotation, to allow insertion of the receptacle into the plug shell only in one position of relative rotation. A coupling ring on the plug shell has registration elements that must be aligned with corresponding elements of the plug shell in order to permit insertion of the receptacle into the plug shell. Cocking or relative rotation of the coupling ring and plug shell, after insertion of the receptacle into the plug shell, draws the connector parts tightly together and prevents axial separation. A spring detent is provided to retain a selected position of relative rotation of the coupling ring and plug shell and to allow manual rotation of the coupling ring after insertion of the receptacle into the plug shell. However, this spring detent also permits negligent or inadvertent cocking or relative rotation of the coupling ring and plug shell prior to insertion of the receptacle into the plug shell. Such precocking misaligns the registration elements of the coupling ring and plug shell and prevents insertion of the receptacle into the plug shell. The improper relative rotation of the coupling ring or its precocking cannot be readily determined by visual observation or may be overlooked by negligent personnel. Thus, attempts to mate the connector parts may be made when such mating is prevented by the improper rotation position of the coupling ring. This may result in damage to the connector, or additional time and effort for determining and correcting the inability to mate the connector parts. The coupling ring, when inadvertently precocked, may require large manual force to rotate it back to its aligned position. This may lead one to use a tool to apply greater rotational force whereby the great force applied by the tool may be applied in the wrong direction or be so large as to damage the connector.

Accordingly it is an object of the present invention to provide an electrical connector that avoids or minimizes problems stated above.

SUMMARY OF THE INVENTION

In carrying out principles of the present invention, in accordance with a preferred embodiment thereof, an electrical connector in which a coupling ring is rotated to lock connector parts together, is provided with locking means for preventing relative rotation of the coupling ring and a first one of the connector parts. Also provided are means responsive to partial connection of the connector parts for disabling the locking means, whereby the coupling ring can be rotated relative to the first connector part only after partial connection of the parts.

BRIEF DESCRIPTION OF THE DRAWINGS

FIG. 1 is an exploded perspective view of parts of an electrical connector embodying principles of the present invention;

FIG. 2 is a longitudinal sectional view of the connector parts as they begin to be connected to one another;

FIG. 3 is an enlarged fragmentary view illustrating operation of the locking ring;

DETAILED DESCRIPTION OF THE DRAWINGS

Figure 4:
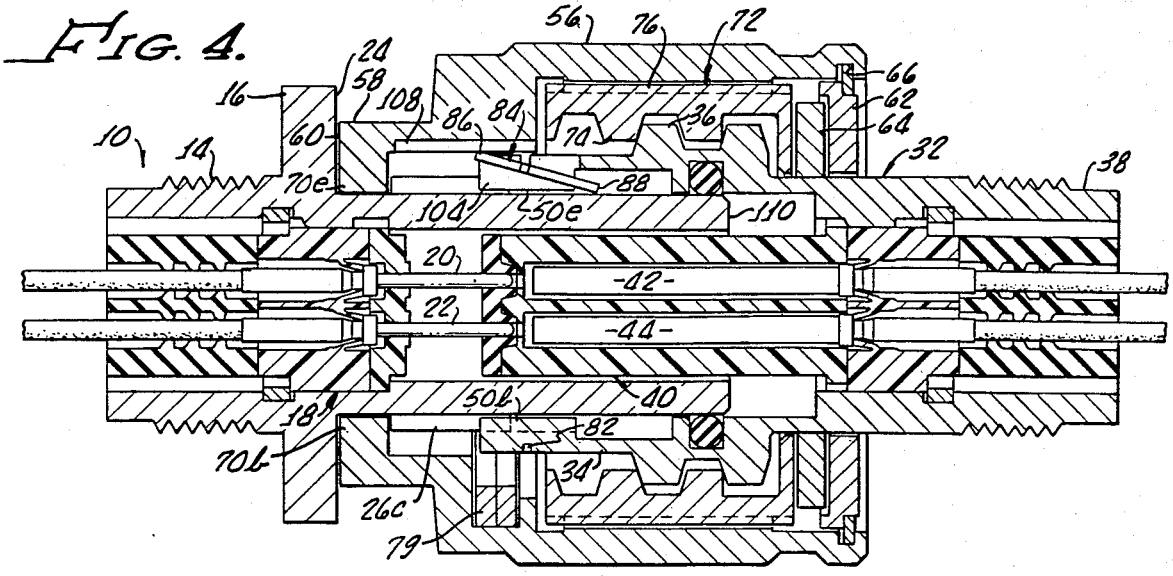
FIG. 4 shows the connector mechanical parts in engagement with one another with the electrical contacts ready to be interengaged by rotation of the coupling ring.

Referring to FIGS. 1, 2, 5 and 7, an electrical connector embodying principles of the present invention includes a receptacle part 10 having a tubular housing 12 at a forward end and a threaded rear end 14 separated from the forward end by a transverse mounting plate 16. A contact assembly 18 is fixed to and within the receptacle housing and has a plurality of pin contacts 20, 22 projecting forwardly therefrom within the housing 12.

Figure 5:
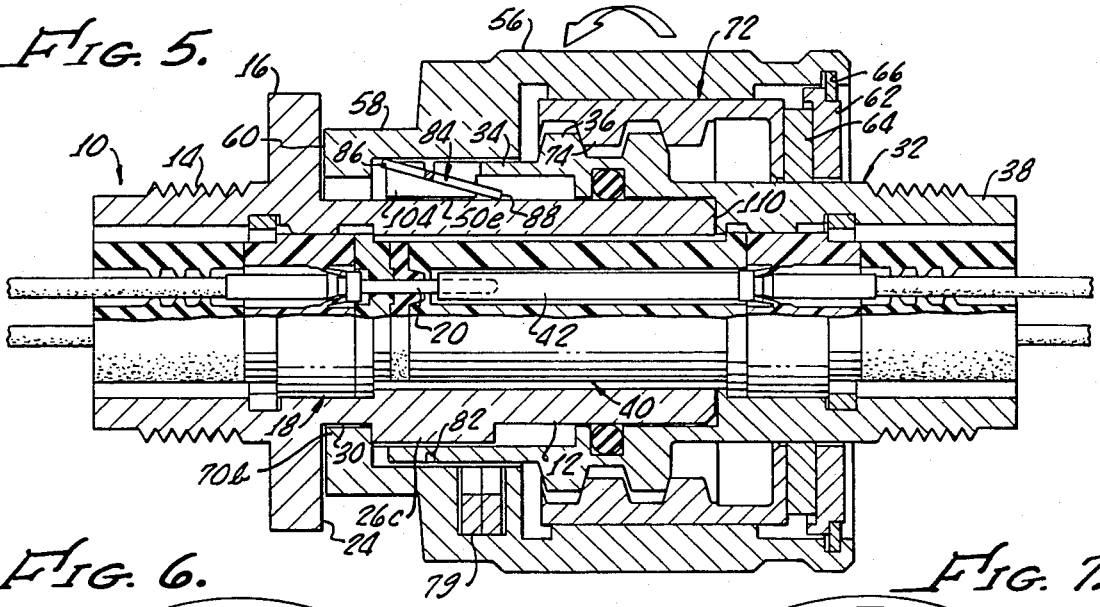
FIG. 5 shows the connector parts fully engaged.

Fixed to the exterior of the forward housing section 12 and spaced slightly forwardly of the forward surface 24 of mounting plate 16 are a plurality of radially outwardly projecting keys 26*a*, 26*b*, 26*c*, 26*d* and 26*e* (FIG. 7) mutually separated by keyways 27*a*, 27*b*, 27*c*, 27*d* and 27*e*. The rearmost ends of each of the keys 26 are spaced forwardly of the forward surface 24 of mounting plate 16 to provide a circumferentially extending but discontinuous latching recess 30 (FIGS. 2 and 5).

The second connector part, which may be termed a plug shell 32, includes a forward tubular section 34 having a coarse external thread 36 and a threaded rear body portion 38. Fixed to and within the body portion 38 and extending to the forward end of the section 34, is a smaller diameter socket contact assembly 40 having plurality of socket contacts 42, 44 (FIG. 4) adapted to receive pin contacts 20 and 22 of the receptacle. Contact assembly 40 is spaced radially from the outer plug shell section 34 to provide an annular bore 46 that receives the forward tubular housing 12 of the receptacle when the two parts are mated.

Figure 6:
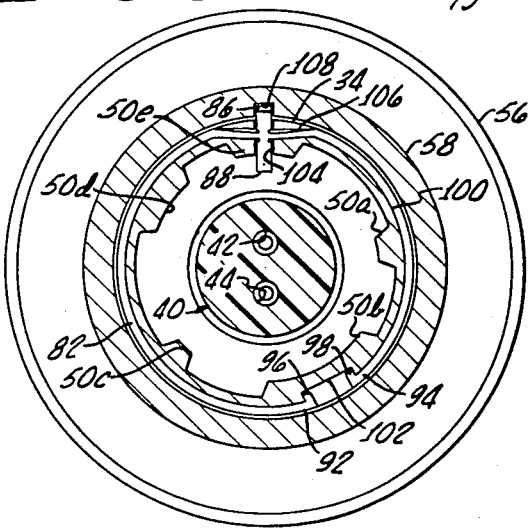
FIG. 6 is a section taken on lines 6—6 of FIG. 2 showing the locking finger in locking position.
Figure 7:
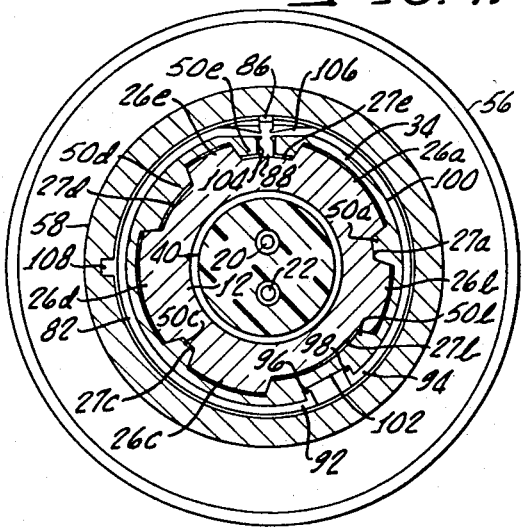
FIG. 7 is a view like that of FIG. 6 showing the locking finger in unlocked position, and after rotation of the coupling ring.

The forward end of the interior of bore 46 of the plug shell is formed with a plurality of registration elements adapted to mate with the similar registration elements of the receptacle. These elements include a plurality of the keys 50*a*, 50*b*, 50*c*, 50*d* and 50*e*, (FIG. 6) that may be registered with and received by the receptacle keyways 27*a*, 27*b*, 27*c*, 27*d* and 27*e*, respectively.

An externally knurled coupling ring 56 is formed with a necked down forward portion 58 terminating in a radially inwardly projecting flange 60. Flange 60 is formed with a plurality of radially inwardly projecting registration elements that can be registered with the registration elements of the plug shell and receptacle. Thus the coupling ring flange includes keys 70*a*, 70*b*, 70*c*, 70*d* and 70*e* which are congruent with and may be aligned with the corresponding keys 50*a* through 50*e* of the plug shell.

Mounted within the coupling ring for limited axially sliding motion, is a drive nut 72 having coarse internal threads 74 engaged with the coarse external threads 36 of the plug shell and having a plurality of longitudinal splines such as those indicated at 76, 78 that are received in corresponding longitudinally extending inwardly directed grooves in the interior of the coupling ring 56. Therefore the drive nut is longitudinally shiftable but rotationally fixed to the coupling ring. Spacing rings 62 and 64 are mounted within the rear portion of the coupling ring and held in place by a snap ring 66. These spacing rings circumscribe the rear section of the plug shell to retain the drive nut 72 within the coupling ring. A spring detent 79 is employed, as described in U.S. Pat. No. 4,066,315, for example, to provide manually releasable and identifiable latching of the relative rotational positions of coupling ring and plug shell.

Operation of the described connector (but without the locking mechanism, to be described below) is as follows: The coupling ring is rotationally positioned with respect to plug shell so as to align the several keys 70*a* through 70*e* with the corresponding keys 50*a* through 50*e* of the plug shell. These aligned keys are then rotationally aligned with the corresponding keyways 27*a* through 27*e* of the receptacle by rotating the receptacle relative to the assembly of plug shell and coupling ring, while the spring detent maintains their relative rotational alignment of the assembly of plug shell and ring. The parts then are mated by relative axial motion in which the receptacle is manually inserted into the plug shell, with the forward portion of receptacle housing 12 passing first through the forward section 58 of the coupling ring and then into the bore 46 of the plug shell. When the receptacle has almost, but not entirely, reached its final seated position, flange 60 of the coupling ring is within the groove or peripheral latch recess 30, as best seen in FIG. 4. The pin contacts are adjacent to, but have not yet entered the socket contacts. With the parts in the nearly mated position illustrated in FIG. 4, coupling ring 56 is rotated through a quarter turn to thereby rotate drive nut 72. The latter initially may move slightly rearwardly until it abuts spacer ring 64, whereupon further rotation of the coupling ring longitudinally drives the plug shell relative to the coupling ring, driving the plug shell further toward the receptacle which is longitudinally locked to the coupling ring by interengagement of the coupling ring flange 60 and latch recess 30. Thus a fraction of a turn, such as a 90° twist of the coupling ring, serves both to finally draw the connector parts together (FIG. 5) to accomplish their electrical engagement and to rotate the coupling ring keys relative to the receptacle keyways and within the latching recess behind the receptacle keys. This prevents axial shifting of the coupling ring relative to the receptacle which in turn prevents relative axial shifting of the plug shell relative to the receptacle.

If the coupling ring 56 is precocked, that is, rotated (before the connector parts are mated) relative to the plug shell from the position wherein its keyways 70 are aligned with the plug shell keyways 50, the receptacle and plug shell cannot be mated with one another. As mentioned above, the spring pressed detent 79 indicates the position of relative alignment of the coupling ring and plug shell, but will not prevent inadvertent precocking of the coupling ring. Such detent, at most, will provide some resistance to relative rotation of the coupling ring and plug shell, but such resistance is not large enough to prevent manual rotation of the coupling ring. Such inadvertent precocking of the coupling ring is possible prior to the first mating of the receptacle and plug shell. Also when the parts are subsequently disconnected for repair or replacement of other components of a system in which the connectors are employed, it is possible that the coupling ring will be rotationally displaced and thereby prevent connection or reconnection of the receptacle plug shell.

To avoid such inadvertent precocking of the coupling ring, there is provided a locking ring 80 having a substantially circular ring section 82, to which is movably secured a locking finger 84 having a locking section 86 and an operator section 88. The ring section includes a straight chordal portion 90 to which is secured the finger 84. Closely spaced but separate ends 92, 94 of the ring are formed with radially inwardly projecting ears 96, 98. The ring is formed as a flat stamping in a single integral piece with the locking finger lying in the plane of the ring section 82. The locking finger is then rotated, twisting the chordal section 90 to a position in which the finger extends at an angle from the plane of the ring. Although such angle may vary widely, it is presently preferred to use an angle of 30° between the longitudinal extent of the locking finger and the plane of the ring. After bending the finger from the plane of the ring the entire locking ring is heat treated to make it resilient and to resiliently retain the ring in its angled position. Thus the locking finger or, more precisely stated, the chordal portion, thereafter may be twisted to increase or decrease the angle that it makes with the plane of the ring and, because of its resilience, tends to return to its natural unstressed angled position.

Plug shell 32 has its forward section 34 formed with a circumferentially extending groove 100 having a radially extending holding recess 102 (FIGS. 1 and 6) at one side and, at the other side (displaced from the recess 102 by less than 180°) a longitudinally extending slot 104 that opens forwardly through the front end of the plug shell. Slot 104 is formed in a thicker portion of the plug shell, conveniently in the key 50*e* wherein the plug shell wall is of increased thickness.

The locking finger resiliently pivots about the chordal section 90 on an axis 106 (FIG. 3). Locking section 86 of the locking finger projects into a longitudinally extending recess 108 (FIGS. 2, 3, 6), formed in an interior wall of the coupling ring 56 whereby relative rotation of the coupling ring and plug shell is prevented when the parts are in the position illustrated in solid lines in FIG. 3. The circumferential locations of the locking finger 84 and locking groove 108 are arranged so that, with the locking finger received in groove 108 of the coupling ring, the two parts are locked with their keys and keyways in registration with one another, thereby to permit insertion of the receptacle through the coupling ring into the bore of the plug shell. Inadvertent precocking of the coupling ring is positively prevented by the interengaging locking provided by locking finger 84 and locking recess 108. The locking ring is rotationally fixed to the plug shell by reception of the ring ears 96, 98 in the holding recess 102. This also prevents radial displacement of the entire ring that would tend to lift the ring out of groove 100. The locking ring finger, when captured in locking recess 108, prevents forcible rotation of the coupling ring either by exertion of manually applied force or by a larger force applied by a tool. The connector thus becomes nearly fool proof, in this aspect. There is no need to rely on the relatively weaker rotational resistance of the detent.

Upon partial insertion of the receptacle, through the coupling ring and into the plug shell (FIG. 3), the chamfered forward edge 110 of the receptacle, contacts the locking ring operator section 88 which extends inwardly and rearwardly into the plug shell bore 46. This contact pivots the locking ring in a counterclockwise direction (as viewed in FIG. 3). When the receptacle end 110 has been inserted entirely past the locking ring operator section 88, the locking finger is in the position illustrated in dotted lines in FIG. 3 with its locking section 86 completely withdrawn from the locking recess 108. Thus the coupling ring is now free to rotate relative to the plug shell. Continued relative axial motion of the receptacle and plug shell, brings the radial flange 60 of the coupling ring past the rearward end of the keys 26 of the receptacle and into the latching recess 30. In this position the coupling ring may be rotated (through about one quarter turn) to operate as described above. Such rotation of the coupling ring tightly draws the plug shell and receptacle together through the final axial motion from the position shown in FIG. 4 to the fully mated and locked position of FIG. 5. This rotation of the coupling ring causes the parts to move from the position illustrated in FIG. 6 to that illustrated in FIG. 7. The latter shows the coupling ring locking recess 108 circumferentially displaced from the locking finger 84 so that the non-recessed inner wall of the coupling ring holds the resiliently mounted locking finger in its unlocked position.

In order to ensure that the insertion of receptacle 10 into the plug shell bore will fully withdraw the locking finger section 86 from the groove 108, the locking finger pivot point 106 must be positioned at a relatively greater distance inwardly of the outermost wall of the plug shell. If the pivot point 106 is raised (as viewed in FIG. 3) insertion of the receptacle will cause a smaller amount of counterclockwise rotation of the locking finger, which may not be sufficient to retract the locking section 86 from groove 108. Partly for this reason, the locking finger is positioned in the key 50*e* where the plug shell wall is of increased thickness. For the same reason, the circumferential groove 100 in the plug shell is made deeper at key 50*e* to receive the chordal section 90 of the locking ring, thus ensuring proper positioning of the pivot axis 106.

Upon initial insertion of the receptacle into the plug shell, contact of the receptacle end 110 with locking ring operator section 88, urges the entire locking ring radially outwardly (upwardly as viewed in FIG. 3). Such upward displacement of the locking finger may interfere with the desired pivotal motion of the finger so that the entire finger could possibly move upwardly without withdrawing the locking section 86 from groove 108. To avoid such a situation, ears 90 and 94 are provided on the ends of the locking ring and captured in the holding recess 102. These ears prevent radial displacement of the entire locking ring, securely holding the ring in groove 100 and ensuring that the locking finger pivots rather than moves bodily.

The described apparatus provides a positive rotational positioning of the coupling ring, locking it against inadvertent displacement, with the locking of the ring being automatically disabled when connection of the receptacle to the plug shell is begun.

The foregoing detailed description is to be clearly understood as given by way of illustration and example only, the spirit and scope of this invention being limited solely by the appended claims.

What is claimed is:

1. In an electrical connector having first and second connector parts adapted to be connected to one another by relative axial motion and including mutually interengagable registration elements that allow connection of the parts in a predetermined relative rotational position, said connector having a coupling ring rotatably engaged with said first part and adapted to engage said second part for driving said parts together after the parts have been partially connected, said coupling ring having coupling ring registration elements in registration with the registration elements of said first part in an aligned position of said coupling ring to permit relative axial motion of the parts, said coupling ring registration elements preventing connection of said parts to each other when said coupling ring is rotated from said aligned position, the improvement comprising locking means for preventing relative rotation of said coupling ring and said first part, and means responsive to partial connection of said first and second parts for disabling said locking means, whereby said coupling ring can be rotated relative to said first connector part only after partial connection of said parts.

2. The electrical connector of claim 1, wherein said locking means comprises a locking element movably mounted on one of said coupling ring and first connector part and having a locking portion in locking engagement with the other of said coupling ring and first connector part for preventing relative rotation, said locking element including an actuator portion adapted to be engaged by said second connector part as said first and second connector parts are moved axially toward each other, said actuator portion of said locking element including means for shifting said locking portion of said actuator element out of its locking engagement with said other of said coupling ring and first connector part.

3. The connector of claim 1 wherein said locking means comprise a locking recess formed in said coupling ring, and a locking finger movably mounted to said first connector part and having a first portion extending into said locking recess, said means for disabling comprising a second portion of said locking finger extending into the path of said second connector part during connection of said first and second connector parts by relative axial motion, whereby engagement of said second connector part with said locking finger second portion will shift said first locking finger portion from said locking recess.

4. The electrical connector of claim 3 wherein said locking means comprises a circumferential groove in said first connector part, a locking ring mounted in said groove, said locking finger being resiliently mounted to said locking ring.

5. The electrical connector of claim 1, wherein said locking means comprises a locking groove in said coupling ring, a circumferential groove in said first connector part, a resilient locking ring mounted in said circumferential groove, said resilient locking ring having a locking finger secured thereto and extending therefrom at an angle to the plane of the ring, said finger having a first portion extending into said locking groove and a second portion extending into the path of said second connector part when said connector parts are moved axially of each other, whereby relative axial motion of said connector parts will shift said locking finger to withdraw said first locking finger portion from said locking groove, and whereby said coupling ring may be rotated relative to said connector parts after said connector parts have been partially interconnected with one another.

6. The electrical connector of claim 1, wherein said locking means comprises a first axial groove in said coupling ring, a circumferential groove in said first connector part, and a second axial groove in said first connector part intersecting said circumferential groove, a resilient locking ring having an integral finger extending therefrom at an angle to the plane of the locking ring and in both directions from the plane of the locking ring, said locking ring being received in said circumferential groove, said locking finger extending along said second axial groove and having a portion extending into said first axial groove of said coupling ring, said first connector part including a bore adapted to receive said second connector part when the two parts are moved axially of one another for connection, said locking finger including a portion extending into said bore and adapted to be contacted by said second connector part to thereby shift said finger from said first axial groove of said coupling ring when the first and second connector parts are moved axially of one another for connection.

7. The electrical connector of claim 6, wherein said locking ring is discontinuous and has first and second ends, each said locking ring end being formed with an ear extending therefrom, said first part having a holding recess receiving said ears.

8. The electrical connector of claim 7, wherein said circumferential groove has a deeper portion at said first axial groove, said locking ring having a chordal section in said deeper groove portion.

9. The electrical connector of claim 1 including means on said second part for maintaining the locking means in disabled condition when said connector parts are connected to one another.

10. An electrical connector comprising a receptacle having a first set of contacts, a plug shell having a second set of contacts and including a bore adapted to receive said receptacle when the latter is axially inserted into said plug shell bore for mating of said first and second sets of contacts, said plug shell and receptacle having mutually interengageable registration elements to permit insertion of the receptacle into the plug shell bore in only one position of relative rotation of the receptacle and plug shell, a coupling ring mounted on said plug shell for rotation relative thereto, said coupling ring having registration elements adapted to be registered with the registration elements of said receptacle and plug shell, interengaging means on said receptacle and coupling ring for preventing relative axial motion of said coupling ring and receptacle when the receptacle has been inserted into the plug shell bore, means connected to said coupling ring for axially shifting said plug shell relative to the coupling ring and receptacle in response to rotation of the coupling ring, locking means for preventing relative rotation of said coupling ring and plug shell, and means responsive to insertion of said receptacle into said plug shell bore for disabling said locking means whereby said coupling ring may be rotated relative to said plug shell only after said receptacle has been inserted into said plug shell bore.

11. The connector of claim 10, wherein said locking means comprises a locking groove in said coupling ring, and a locking finger mounted to said plug shell for motion between a lock position, in which the finger extends into said locking groove, and an unlock position in which the finger is displaced from said coupling ring locking groove.

12. The connector of claim 10, wherein said locking means comprises a longitudinally extending locking groove in said coupling ring, a locking ring fixed to said plug shell, said locking ring having a locking finger resiliently connected thereto, said locking finger having a first part extending into said locking groove and a second part extending into said plug shell bore when said locking means is in locking position, said second part comprising said means for disabling said locking means.

13. The connector of claim 12, wherein said plug shell includes a circumferential groove, said locking ring being mounted in said groove, said plug shell having a longitudinally extending slot intersecting said groove and receiving said locking finger.

14. The connector of claim 13, wherein said locking ring and locking finger are integral with one another and formed of a resilient material, said locking finger extending at an angle to the plane of the locking ring and in both directions from said plane.

15. The connector of claim 14 wherein said plug shell includes a holding recess, said locking ring including first and second ends spaced from said locking finger, each said end including an ear extending into said plug shell holding recess, thereby to hold said locking ring in said circumferential groove.

16. The connector of claim 10 including means on said receptacle for maintaining said locking means in disabled condition.

* * * * *